US011520252B2

(12) United States Patent
Yoshioka et al.

(10) Patent No.: US 11,520,252 B2
(45) Date of Patent: Dec. 6, 2022

(54) IMAGE FORMING APPARATUS

(71) Applicant: FUJIFILM Business Innovation Corp., Tokyo (JP)

(72) Inventors: Tomoaki Yoshioka, Ebina (JP); Masaaki Takahashi, Ebina (JP); Kazuyoshi Hagiwara, Ebina (JP); Yoko Miyamoto, Ebina (JP); Toshiaki Baba, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/337,923

(22) Filed: Jun. 3, 2021

(65) Prior Publication Data

US 2021/0286294 A1 Sep. 16, 2021

Related U.S. Application Data

(63) Continuation of application No. PCT/JP2019/028022, filed on Jul. 17, 2019.

(30) Foreign Application Priority Data

Feb. 28, 2019 (JP) ..... JP2019-035281

(51) Int. Cl.
*G03G 15/16* (2006.01)

(52) U.S. Cl.
CPC ..... *G03G 15/1605* (2013.01); *G03G 15/167* (2013.01)

(58) Field of Classification Search
CPC ..... G03G 15/1605; G03G 15/167; G03G 15/1615; G03G 15/657; G03G 2215/00413; B65H 5/08
See application file for complete search history.

(56) References Cited

U.S. PATENT DOCUMENTS 6,587,232 B1 * 7/2003 Yamamoto ..... B41J 2/465 358/496
2010/0165033 A1 7/2010 Fukui
(Continued)

FOREIGN PATENT DOCUMENTS

JP S63-202552 A 8/1988
JP H08-305109 A 11/1996
(Continued)

OTHER PUBLICATIONS

Oct. 1, 2019 International Search Report issued in International Patent Application No. PCT/JP2019/028022.
(Continued)

*Primary Examiner* — Arlene Heredia
(74) *Attorney, Agent, or Firm* — Oliff PLC

(57) ABSTRACT

An image forming apparatus includes: an annular transfer belt having an outer surface on which an image is transferred; a nip portion that forms a nip region for nipping a recording medium with an outer surface of the transfer belt; a facing portion that faces the nip region from an inner side of the transfer belt and transfers the image from the transfer belt to the recording medium in the nip region by charging the transfer belt; and a transport unit including a holding portion that holds the recording medium, transports the recording medium by moving the holding portion, and causes the recording medium together with the holding portion to pass the nip region while holding the recording medium at the holding portion.

5 Claims, 19 Drawing Sheets

(56) References Cited

U.S. PATENT DOCUMENTS

| | | | | |
|---|---|---|---|---|
| 2011/0044731 | A1 | 2/2011 | Nomura et al. | |
| 2012/0314013 | A1* | 12/2012 | Takemoto | B41J 11/002 347/102 |
| 2016/0185125 | A1* | 6/2016 | Aihara | B41J 2/325 347/217 |

FOREIGN PATENT DOCUMENTS

| | | | |
|---|---|---|---|
| JP | H09-204086 | A | 8/1997 |
| JP | 2011-008058 | A | 1/2011 |
| JP | 2011-043697 | A | 3/2011 |
| JP | 2011-138063 | A | 7/2011 |
| JP | 2012-096863 | A | 5/2012 |
| JP | 2012-140242 | A | 7/2012 |
| JP | 5224524 | B2 | 7/2013 |
| JP | 2016-124181 | A | 7/2016 |
| JP | 2016-167022 | A | 9/2016 |

OTHER PUBLICATIONS

Oct. 1, 2019 Written Opinion issued in International Patent Application No. PCT/JP2019/028022.
Sep. 27, 2022 Office Action issued in Japanese Patent Application No. 2019-035281.

* cited by examiner

IMAGE FORMING APPARATUS

CROSS REFERENCE TO RELATED APPLICATIONS

This is a continuation of International Application No. PCT/JP2019/028022 filed on Jul. 17, 2019, and claims priority from Japanese Patent Application No. 2019-035281 filed on Feb. 28, 2019.

BACKGROUND

Technical Field

The present invention relates to an image forming apparatus.

Related Art

Patent Literature 1 discloses a configuration in which a gripper provided on a peripheral surface of a transport drum grips a tip end portion of a sheet of paper to transport the paper.

CITATION LIST

Patent Literature

Patent Literature 1: JP-A-2012-96863

SUMMARY

In a case where an image is transferred in a nip region where the recording medium is nipped between the nip portion around which the transfer belt is wound and the transfer belt, when the recording medium is transported only by the pair of transport rollers, a peel failure in which the recording medium is not peeled from the nip portion may occur.

Aspects of non-limiting embodiments of the present disclosure relate to suppress a peel failure in which a recording medium to which an image is transferred is not peeled from a nip portion compared to a configuration in which a recording medium is transported only by a pair of transport rollers.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an annular transfer belt having an outer surface on which an image is transferred; a nip portion which forms a nip region for nipping a recording medium with an outer surface of the transfer belt; a facing portion that faces the nip region from an inner side of the transfer belt and transfers the image from the transfer belt to the recording medium in the nip region by charging the transfer belt; and a transport unit which includes a holding portion that holds the recording medium, transports the recording medium by moving the holding portion, and causes the recording medium together with the holding portion to pass the nip region while holding the recording medium at the holding portion.

BRIEF DESCRIPTION OF THE DRAWINGS

Exemplary embodiment(s) of the present invention will be described in detail based on the following figures, wherein.

DETAILED DESCRIPTION

Hereinafter, an exemplary embodiment according to the present invention will be described with reference to the drawings.

(Image Forming Apparatus 10)

Figure 1:
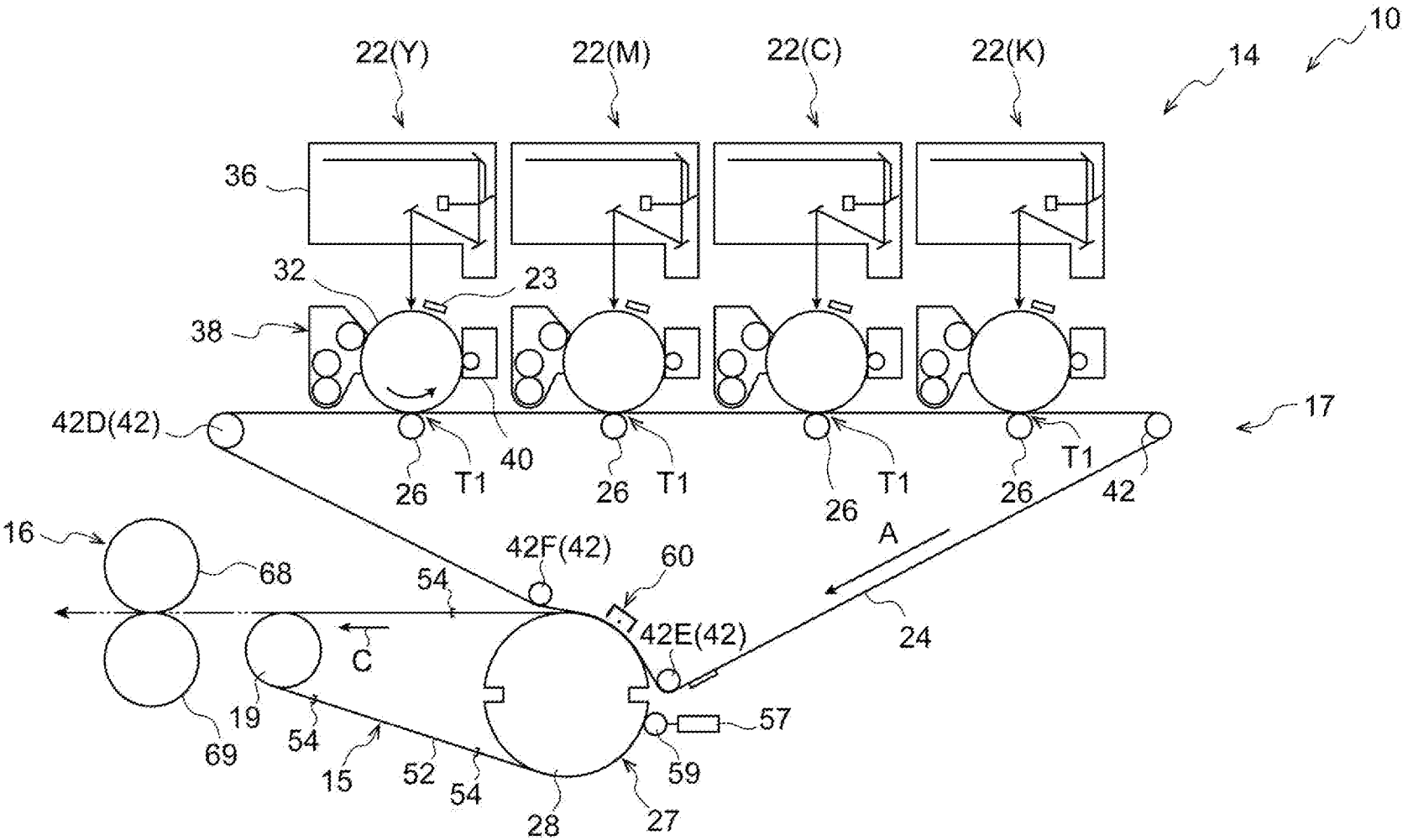
FIG. 1 is a schematic diagram illustrating an image forming apparatus according to an exemplary embodiment.

A configuration of an image forming apparatus 10 according to the exemplary embodiment will be described. FIG. 1 is a schematic diagram illustrating a configuration of an image forming apparatus 10 according to the exemplary embodiment. The image forming apparatus 10 illustrated in FIG. 1 is an example of an image forming apparatus that forms an image on a recording medium. Specifically, the image forming apparatus 10 is an electrophotographic image forming apparatus that forms a toner image (an example of an image) on a recording medium P. More specifically, the image forming apparatus 10 includes an image forming unit 14, a transport unit 15, and a fixing device 16. Hereinafter, each part (the image forming unit 14, the transporting unit 15, and the fixing device 16) of the image forming apparatus 10 will be described.

(Image Forming Unit 14)

The image forming unit 14 has a function of forming a toner image (an example of an image) on the recording medium P. Specifically, the image forming unit 14 includes a toner image forming unit 22 and a transfer device 17.

(Toner Image Forming Unit 22)

Toner image forming units 22 illustrated in FIG. 1 are provided so as to form a toner image for each color. In the exemplary embodiment, toner image forming units 22 of a total of four colors of yellow (Y), magenta (M), cyan (C), and black (K) are provided. The (Y), (M), (C), and (K) illustrated in FIG. 1 show constituent portions corresponding to the respective colors.

In the image forming apparatus 10, when it is necessary to distinguish yellow (Y), magenta (M), cyan (C), and black (K), (Y), (M), (C), and (K) are attached after the reference numerals of the respective members, and when it is not necessary to distinguish the respective colors, (Y), (M), (C), and (K) may be omitted. Since the toner image forming unit 22 of each color is configured in the same manner except for the toner to be used, on behalf of the toner image forming unit 22 of each color, each part of the toner image forming unit 22 (Y) is denoted by a reference numeral in FIG. 1.

Specifically, the toner image forming unit 22 of each color includes a photosensitive drum 32 (photoconductor) that rotates in one direction (for example, in the counterclockwise direction in FIG. 1). The toner image forming unit 22 of each color includes a charger 23, an exposure device 36, a developing device 38, and a removing device 40.

In the toner image forming unit 22 of each color, the charger 23 charges the photosensitive drum 32. Further, the exposure device 36 exposes the photosensitive drum 32 charged by the charger 23 to form an electrostatic latent image on the photosensitive drum 32. The developing device 38 develops the electrostatic latent image formed on the photosensitive drum 32 by the exposure device 36 to form a toner image. After the toner image is transferred to the transfer belt 24 to be described later, the removing device 40 removes the toner remaining on the photosensitive drum 32.

(Transfer Device 17)

The transfer device 17 illustrated in FIG. 1 is a device that transfers the toner image formed on the photosensitive drum 32 in the toner image forming unit 22 to the recording medium P. Specifically, the transfer device 17 primarily transfers the toner images of the photosensitive drums 32 of the respective colors onto the transfer belt 24 as an intermediate transfer body, and secondarily transfers the superimposed toner images onto the recording medium P at a secondary transfer position T2 (a nip region 28A described later). More specifically, as illustrated in FIG. 1, the transfer device 17 includes a transfer belt 24, a primary transfer roller 26, a secondary transfer body 27, and a charger 60.

(Primary Transfer Roller 26)

The primary transfer roller 26 illustrated in FIG. 1 is a roller that transfers the toner image of the photosensitive drum 32 of each color to the transfer belt 24 at a primary transfer position T1 between the photosensitive drum 32 and the primary transfer roller 26. In the exemplary embodiment, since a primary transfer electric field is applied between the primary transfer roller 26 and the photosensitive drum 32, the toner image formed on the photosensitive drum 32 is transferred to the transfer belt 24 at the primary transfer position T1.

(Transfer Belt 24)

The transfer belt 24 illustrated in FIG. 1 is an example of an annular transfer belt having an outer surface on which an image is transferred. Specifically, the toner images are transferred from the photosensitive drums 32 of the respective colors to the outer surface of the transfer belt 24. More specifically, the transfer belt 24 is configured as follows. As illustrated in FIG. 1, the transfer belt 24 has an annular shape. Further, the posture of the transfer belt 24 is determined by being wound around rollers 42 including a driving roller 42D and winding rollers 42E, 42F. For example, the driving roller 42D of the rollers 42 is rotationally driven by a drive unit (not illustrated), so that the transfer belt 24 rotates in a predetermined arrow A direction (hereinafter, referred to as a belt circulation direction A). A specific configuration of the winding rollers 42E, 42F will be described later.

(Secondary Transfer Body 27)

Figure 2:
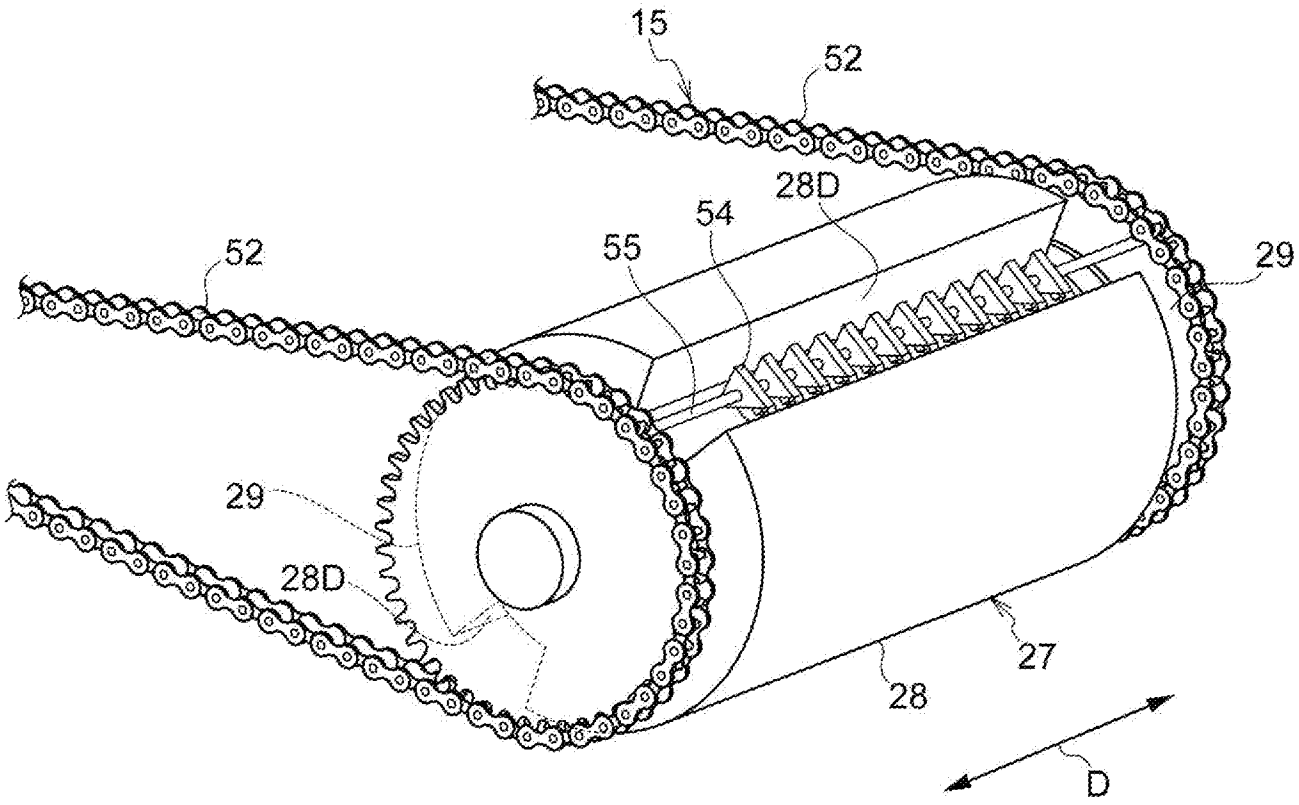
FIG. 2 is an enlarged perspective view of a secondary transfer portion of the image forming apparatus according to the exemplary embodiment.
Figure 3:
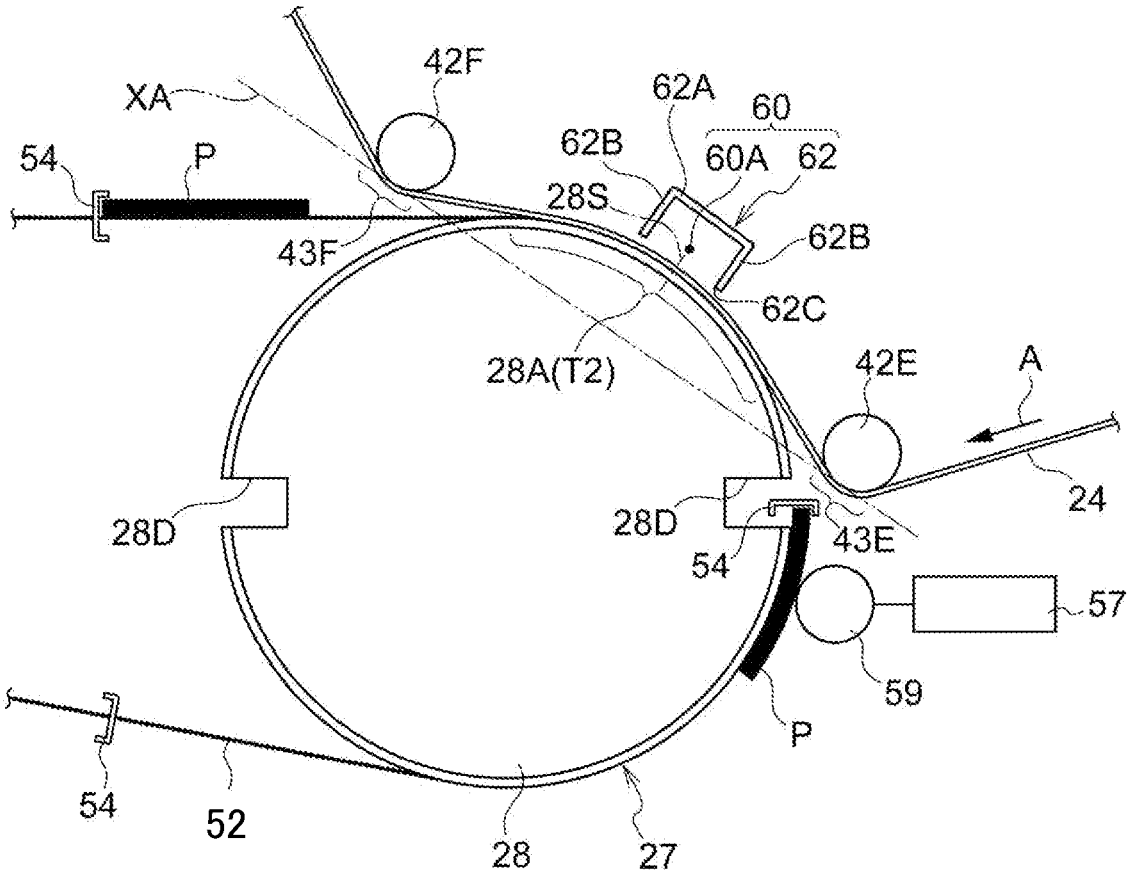
FIG. 3 is an enlarged side view of a secondary transfer portion of the image forming apparatus according to the exemplary embodiment.

The secondary transfer body 27 is an example of a transfer unit. Specifically, as illustrated in FIG. 2, the secondary transfer body 27 includes a transfer cylinder 28 and a pair of sprockets 29. The transfer cylinder 28 is an example of a nip portion having a nip region for nipping the recording medium with the outer surface of the transfer belt 24. Specifically, as illustrated in FIG. 3, the transfer cylinder 28 has a nip region 28A (an example of a nip region) in which the recording medium P is nipped between the transfer cylinder and the outer surface of the transfer belt 24. In FIG. 3, the recording medium P is simplified and a part thereof is illustrated.

The nip region 28A is formed by winding the transfer belt 24 around the transfer cylinder 28. In other words, the nip region 28A is also referred to as a contact region in which the transfer belt 24 and the transfer cylinder 28 are in contact with each other. The nip region 28A is a secondary transfer position T2 at which the toner image is transferred from the transfer belt 24 to the recording medium P. The transfer cylinder 28 transports the recording medium P nipped between the transfer belt 24 and the transfer cylinder 28 in the nip region 28A.

As illustrated in FIG. 2, the pair of sprockets 29 are disposed on both axial end sides of the transfer cylinder 28. In other words, the transfer cylinder 28 is provided between the pair of sprockets 29. Further, the pair of sprockets 29 is disposed coaxially with the transfer cylinder 28 and rotates integrally with the transfer cylinder 28. The secondary transfer body 27 is rotationally driven by a drive unit (not shown).

Figure 4:
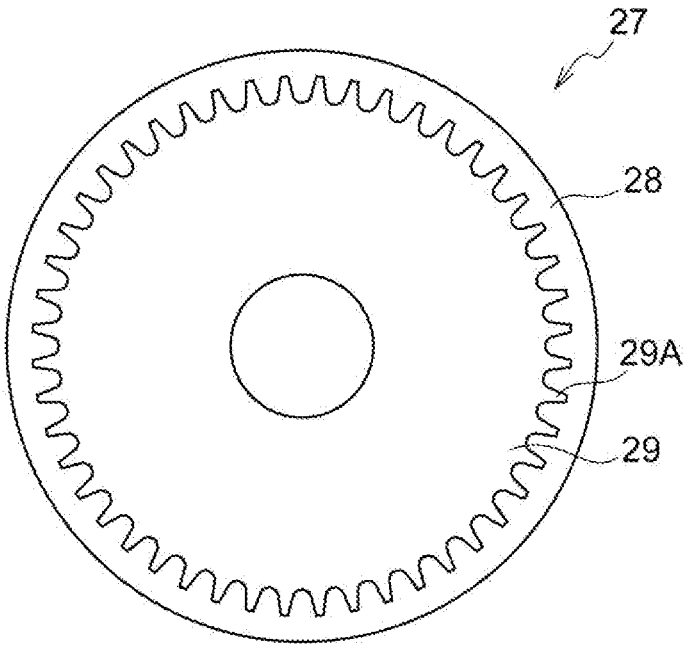
FIG. 4 is a side view illustrating the secondary transfer body according to the exemplary embodiment.

As illustrated in FIG. 4, the outer diameter of the pair of sprockets 29 is smaller than the outer diameter of the transfer cylinder 28. The outer diameter of the sprocket 29 is the outer diameter including the teeth 29A (that is, the length from the tooth tip to the center of the sprocket 29).

Further, two recesses 28D in which grippers 54 and attachment members 55 of the transport unit 15 to be described later are accommodated are formed on the outer circumference of the transfer cylinder 28. The number of the recesses 28D may be one, or may be three or more.

(Charger 60)

The charger 60 is an example of a facing portion that faces the nip portion inside the transfer belt. As illustrated in FIG. 3, the charger 60 is disposed inside the transfer belt 24 so as to face the transfer cylinder 28. Specifically, the charger 60 faces the transfer cylinder 28 in a region including the center 28S of the nip region 28A in the transport direction of the transport unit 15.

The charger 60 is a charger (so-called corotron charger) that transfers a toner image on the transfer belt 24 by corona discharge. Specifically, the charger 60 includes a discharge wire 60A and a case 62 (housing). The discharge wire 60A has a linear shape having a length along the axial direction of the transfer cylinder 28. The discharge wire 60A is not in contact with the inner surface of the transfer belt 24. That is, the discharge wire 60A has a gap with the inner surface of the transfer belt 24.

The case 62 is an example of a surrounding portion that surrounds the discharge wire. The case 62 is formed in a box shape, and has an opening 62C on the transfer cylinder 28 side (that is, the lower side).

Specifically, the case 62 includes a first wall 62A disposed on the side opposite to the transfer cylinder 28 with respect to the discharge wire 60A, and a pair of second walls 62B disposed on the upstream side and the downstream side in the belt circulation direction A with respect to the discharge wire 60A. Further, the case 62 has third walls (not shown) disposed on both end sides in the length direction of the discharge wire 60A.

The case 62 is not in contact with the inner surface of the transfer belt 24. That is, the case 62 has a gap with the inner surface of the transfer belt 24.

The case 62 may have an opening in a third wall (not illustrated) or the like disposed on both end sides in the length direction of the discharge wire 60A, and may have an opening 62C at least on the transfer cylinder 28 side (that is, the lower side).

In the charger 60, a voltage is applied to the discharge wire 60A and is discharged. The discharge of the discharge wire 60A charges the transfer belt 24. As will be described later, the recording medium P electrostatically adsorbed to the transfer cylinder 28 is electrostatically adsorbed to the charged transfer belt 24. Therefore, the toner image superimposed on the transfer belt 24 is transferred from the transfer belt 24 to the recording medium P at the nip region 28A (secondary transfer position T2).

(Winding Rollers 42E, 42F)

The winding rollers 42E, 42F illustrated in FIGS. 1 and 3 are examples of a pair of winding rollers on which the transfer belt is wound inside the transfer belt. The winding roller 42E is disposed on the upstream side in the belt circulation direction A with respect to the charger 60. The winding roller 42F is disposed on the downstream side in the belt circulation direction A with respect to the charger 60.

As illustrated in FIG. 3, the winding rollers 42E, 42F are disposed such that the common external tangent XA of the winding rollers 42E, 42F passes over the transfer cylinder 28 when viewed in the axial direction of the winding rollers 42E, 42F.

Here, the common external tangent XA is a tangent line in which the winding rollers 42E, 42F are disposed on the same side of the tangent line among the tangent lines (that is, the common tangent lines) tangent to both the winding rollers 42E, 42F. More specifically, the common external tangent XA according to the exemplary embodiment is a tangent line tangent to a portion of the winding rollers 42E, 42F around which the transfer belt 24 is wound. In other words, the common external tangent XA according to the exemplary embodiment is a tangent line tangent to the winding rollers 42E, 42F on the transfer drum 28 side with respect to the charger 60.

Further, both of the winding portions 43E, 43F wound around the winding rollers 42E, 42F in the transfer belt 24 are separated from the transfer cylinder 28. The winding portion 43E is a winding portion on the upstream side in the transport direction of the recording medium P with respect to the winding portion 43F.

(Transport Unit 15)

The transport unit 15 illustrated in FIGS. 1 to 3 or the like has a function of transporting the recording medium P. Specifically, the transport unit 15 has a function of transporting the recording medium P and passing the recording medium P through the nip region 28A (see FIG. 3). More specifically, as illustrated in FIGS. 1 and 2, the transport unit 15 includes a pair of sprockets 19, a pair of chains 52, a gripper 54, and an adsorption roller 59. The gripper 54 is an example of a holding portion that holds the recording medium. In FIG. 1, the sprocket 19, the chain 52, and the gripper 54 are illustrated in a simplified manner. In FIG. 3, the chain 52 and the gripper 54 are illustrated in a simplified manner.

As illustrated in FIG. 1, the pair of sprockets 19 are disposed at intervals in the device front-rear direction (D direction in FIG. 2) on the fixing device 16 side (the left side in FIG. 1) with respect to the pair of sprockets 29 included in the secondary transfer body 27. The pair of sprockets 19 are coaxially and integrally rotatable and supported by an apparatus body (not shown) of the image forming apparatus 10.

As illustrated in FIG. 1, the pair of chains 52 are formed in an annular shape. As illustrated in FIG. 2, the pair of chains 52 are disposed at intervals in the device front-rear direction (D direction in FIG. 2). The pair of chains 52 are wound around a pair of sprockets 29 included in the secondary transfer body 27 and a pair of sprockets 19 (see FIG. 1), respectively. When the transfer cylinder 28 having the pair of sprockets 29 rotates, the chain 52 rotates in the circulation direction C (arrow C direction in FIG. 1).

In the exemplary embodiment, the chain 52 advances between the transfer belt 24 and the transfer cylinder 28 on the downstream side in the transport direction with respect to the nip region 28A in a side view. In other words, in a side view, the chain 52 has a gap with respect to the winding portion 43F, and has a gap with respect to the transfer cylinder 28 on the side opposite to the winding portion 43F with respect to the chain 52.

As illustrated in FIG. 2, attachment members 55 to which the gripper 54 is attached is stretched along the device front-rear direction in the pair of chains 52. The attachment members 55 are fixed to the pair of chains 52 at predetermined intervals along the circumferential direction (circulation direction C) of the chains 52.

Figure 5:
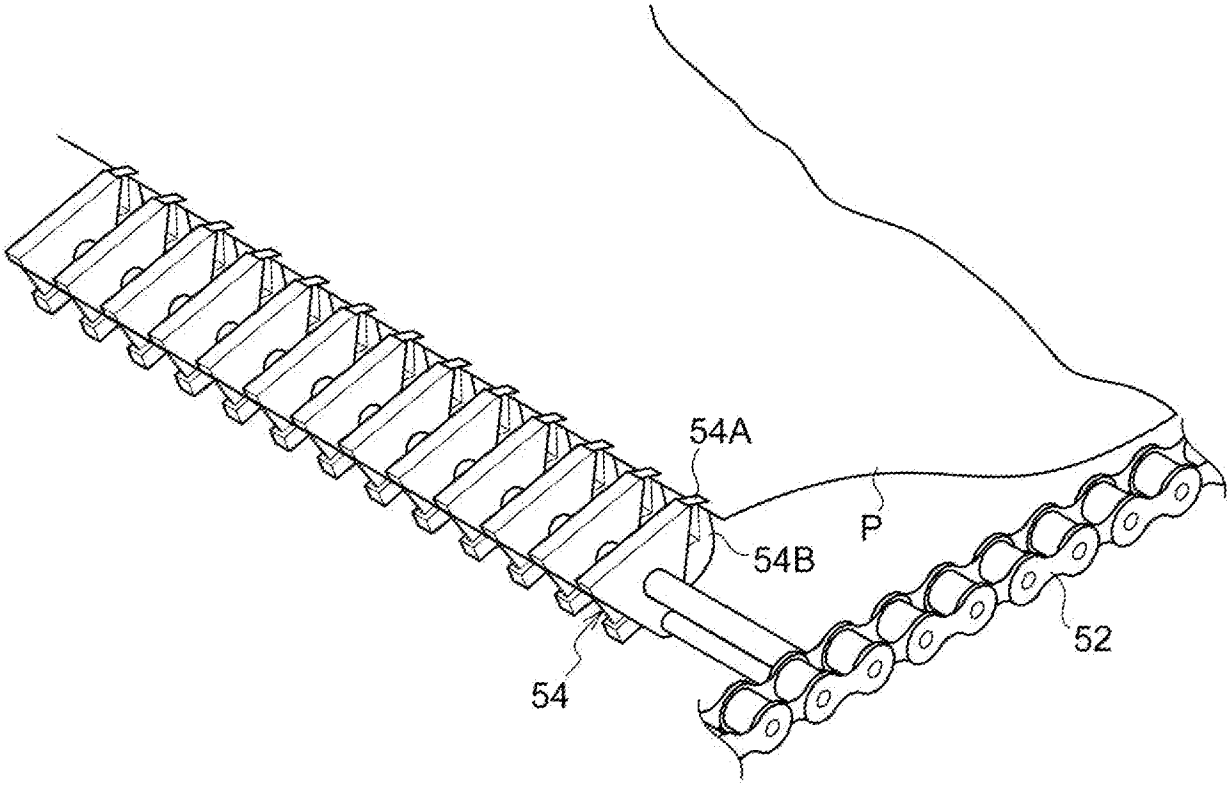
FIG. 5 is a perspective view illustrating the gripper according to the exemplary embodiment.

As illustrated in FIG. 2, plural grippers 54 are attached to the attachment member 55 at predetermined intervals along the device front-rear direction. In other words, the grippers 54 are attached to the chains 52 via the attachment member 55. The gripper 54 has a function of holding the front end portion of the recording medium P. Specifically, as illustrated in FIG. 5, the gripper 54 includes a claw 54A and a claw base 54B. The gripper 54 is configured to hold the recording medium P by nipping the front end portion of the recording medium P between the claw 54A and the claw base 54B. In other words, it can be said that the gripper 54 is an example of a gripping portion that grips the recording medium P in the thickness direction.

More specifically, the gripper 54 holds the front end portion of the recording medium P outside the image region of the recording medium P. The image region of the recording medium P is a region onto which the toner image is transferred in the recording medium P. In the gripper 54, for example, the claw 54A is pressed against the claw base 54B by a spring or the like, and the claw 54A is opened and closed with respect to the claw base 54B by the action of a cam or the like.

Then, in the transport unit 15, as illustrated in FIG. 5, the front end portion of the recording medium P sent from the accommodating unit (not illustrated) in which the recording medium P is accommodated is held by the grippers 54. Further, in the transport unit 15, the chain 52 rotates in the circulation direction C in a state in which the gripper 54 hold the front end portion of the recording medium P. The gripper 54 is moved to transport the recording medium P, and the gripper 54 holds the recording medium P and causes the recording medium P to pass through the nip region 28A together with the gripper 54. Further, the transport unit 15 transports the recording medium P to the fixing device 16 after passing through the nip region 28A.

The adsorption roller 59 is in contact with the transfer cylinder 28 on the upstream side in the transport direction with respect to the nip region 28A. The adsorption roller 59 presses the recording medium P against the transfer cylinder 28, and charges the recording medium P by supplying power from the power supply 57. As a result, the recording medium P is electrostatically adsorbed to the outer circumferential surface of the transfer cylinder 28.

(Fixing Device 16)

The fixing device 16 illustrated in FIG. 1 is a device that fixes the toner image transferred to the recording medium P by the transfer cylinder 28 to the recording medium P. More specifically, as illustrated in FIG. 1, the fixing device 16 includes a heating roller 68 as a heating member and a pressure roller 69 as a pressure member. In the fixing device 16, by heating and pressurizing the recording medium P by the heating roller 68 and the pressure roller 69, the toner image formed on the recording medium P is fixed to the recording medium P.

Effects According to Exemplary Embodiment

Next, effects according to the exemplary embodiment will be described.

According to the image forming apparatus of the exemplary embodiment, the front end portion of the recording medium P sent from the accommodating unit (not illustrated) in which the recording medium P is accommodated is held by the grippers 54, as illustrated in FIG. 5. Further, when the chain 52 rotates in the circulation direction C in a state in which the gripper 54 hold the front end portion of the recording medium P, the gripper 54 is moved to transport the recording medium P, and the gripper 54 holds the recording medium P and causes the recording medium P to pass through the nip region 28A together with the gripper 54 (see FIG. 3). The recording medium P is electrostatically adsorbed to the transfer cylinder 28 by the adsorption roller 59 on the upstream side in the transport direction with respect to the nip region 28A.

When the recording medium P electrostatically adsorbed to the transfer cylinder 28 passes through the nip region 28A, the transfer belt 24 charged by the discharge of the discharge wire 60A in the charger 60 electrostatically adsorbs the recording medium P. By discharging the discharge wire 60A in the charger 60, the toner image superimposed on the transfer belt 24 is transferred from the transfer belt 24 to the recording medium P at the nip region 28A (secondary transfer position T2).

In the exemplary embodiment, as described above, the recording medium P is transported by circulating the chains 52 to which the grippers 54 are attached. Even when the sprocket 29 rotates at a constant speed, the engagement position between the teeth of the sprocket 29 and the teeth of the sprocket 19 and the chain 52 changes as the sprocket 29 and the sprocket 19 rotates, so that the speed of the chain 52 may fluctuate.

Figure 6:
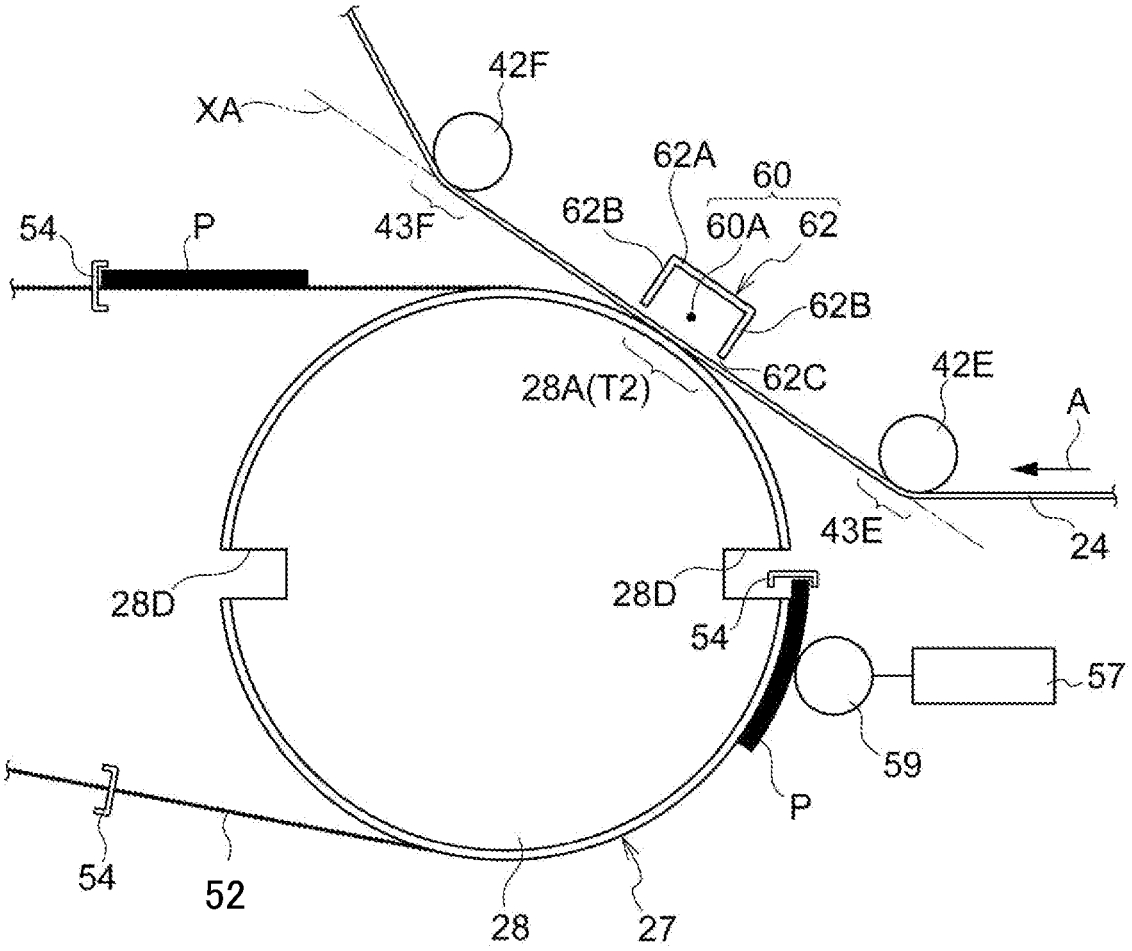
FIG. 6 is an enlarged view illustrating the secondary transfer portion of the image forming apparatus.

Here, in a configuration in which the outer surface of the transfer belt 24 is in point contact with the transfer cylinder 28 (a configuration in which the outer surface of the transfer belt 24 is in line contact with the transfer cylinder 28) as viewed in the width direction of the transfer belt 24 (the depth direction of the paper surface in FIG. 6), the recording medium P may fluctuate in speed in the nip region 28A due to the speed variation of the chains 52. When the recording medium P fluctuates in speed in the nip region 28A, a transfer failure of the toner image may occur.

On the other hand, in the exemplary embodiment, as illustrated in FIG. 3, the nip region 28A is formed by winding the transfer belt 24 around the transfer cylinder 28. Therefore, as compared with a configuration in which the outer surface of the transfer belt 24 is in line contact with the transfer cylinder 28, the nip region 28A in which the recording medium P is nipped between the transfer belt 24 and the transfer cylinder 28 is wider in the belt circulation direction A. Therefore, as compared with a configuration in which the outer surface of the transfer belt 24 is in line contact with the transfer cylinder 28, the speed variation of the recording medium P in the nip region 28A is suppressed, and the transfer failure of the toner image is suppressed. The configuration in which the outer surface of the transfer belt 24 is in line contact with the transfer cylinder 28 may also be referred to as a configuration in which the common external tangent XA is offset from the transfer cylinder 28.

In the exemplary embodiment, as illustrated in FIG. 3, the winding rollers 42E, 42F are disposed such that the common external tangent XA of the winding rollers 42E, 42F passes over the transfer cylinder 28 when viewed in the axial direction of the winding rollers 42E, 42F. Therefore, as compared with a configuration in which the common external tangent XA is offset from the transfer cylinder 28 (see FIG. 6), the nip region 28A is wider in the belt circulation direction A. Therefore, compared with a configuration in which the common external tangent XA is offset from the transfer cylinder 28, the speed variation of the recording medium P in the nip region 28A is suppressed, and the transfer failure of the toner image is suppressed.

The recording medium P is nipped between the transfer belt 24 and the transfer cylinder 28 in the nip region 28A, and thus is attached to the transfer cylinder 28 and the transfer belt 24. Then, for example, when the transfer belt 24 is peeled from the recording medium P, the recording medium P is peeled from the transfer belt 24.

Here, in a configuration in which the recording medium P is transported only by a pair of transport rollers and passes through the nip region 28A (hereinafter, this configuration is referred to as a comparative example), the recording medium P attached to the transfer cylinder 28 is less likely to be pulled in a direction away from the transfer cylinder 28, and is less likely to be peeled off from the transfer cylinder 28. Note that a comparative example in which the recording medium P is transported only by a pair of transport rollers can also be said to be a configuration in which the recording medium P is transported without holding the recording medium P.

On the other hand, in the exemplary embodiment, as described above, the gripper 54 is moved to transport the recording medium P, and the recording medium P is held by the gripper 54, and the recording medium P is caused to pass through the nip region 28A together with the gripper 54.

Therefore, as compared with the comparative example, the recording medium P attached to the transfer cylinder 28 is likely to be pulled in a direction away from the transfer cylinder 28, and is likely to be peeled off from the transfer cylinder 28. Therefore, a peel failure in which the recording medium P to which the toner image is transferred is not peeled off from the transfer cylinder 28 is suppressed.

In the exemplary embodiment, as illustrated in FIG. 3, the winding portion 43E of the transfer belt 24 is separated from the transfer cylinder 28. Therefore, as compared with a configuration in which the winding portion 43E of the transfer belt 24 is in contact with the transfer cylinder 28, the recording medium P is likely to be guided to the nip region 28A.

Furthermore, in the exemplary embodiment, both the winding portion 43E and the winding portion 43F of the transfer belt 24 are separated from the transfer cylinder 28. Therefore, as compared with a configuration in which one of the winding portion 43E and the winding portion 43F is in contact with the transfer cylinder 28, a load (nip load) for nipping the recording medium P between the transfer belt 24 and the transfer cylinder 28 is reduced.

(Modified Examples of Winding Portion 43E and Winding Portion 43F of Transfer Belt 24)

Figure 7:
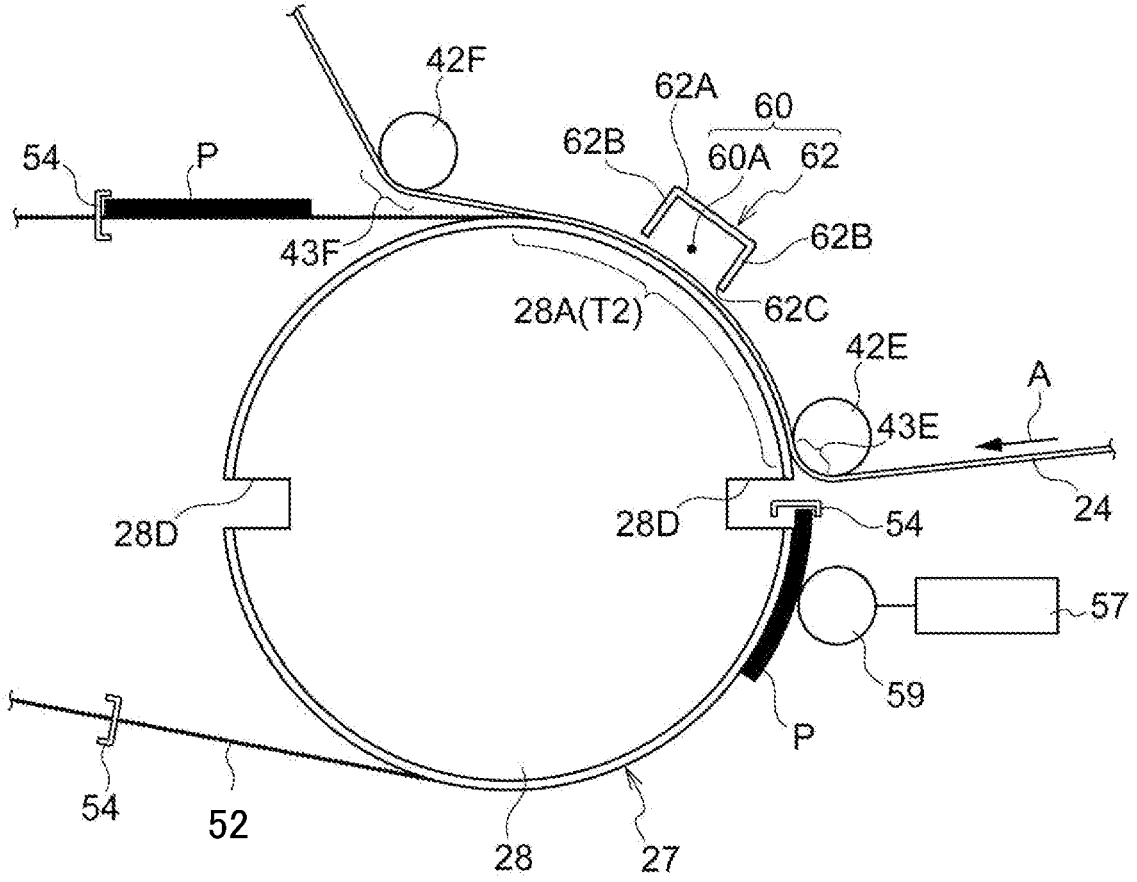
FIG. 7 is an enlarged view illustrating a secondary transfer portion of an image forming apparatus according to a modified example.

In the exemplary embodiment, both the winding portion 43E and the winding portion 43F of the transfer belt 24 are separated from the transfer cylinder 28, but the present invention is not limited thereto. For example, as illustrated in FIG. 7, the winding portion 43E may be in contact with the transfer cylinder 28, and the winding portion 43F may be separated from the transfer cylinder 28.

According to this configuration, as compared with a configuration in which both the winding portions 43E, 43F are separated from the transfer cylinder 28, the nip region 28A is wider in the belt circulation direction A.

Figure 8:
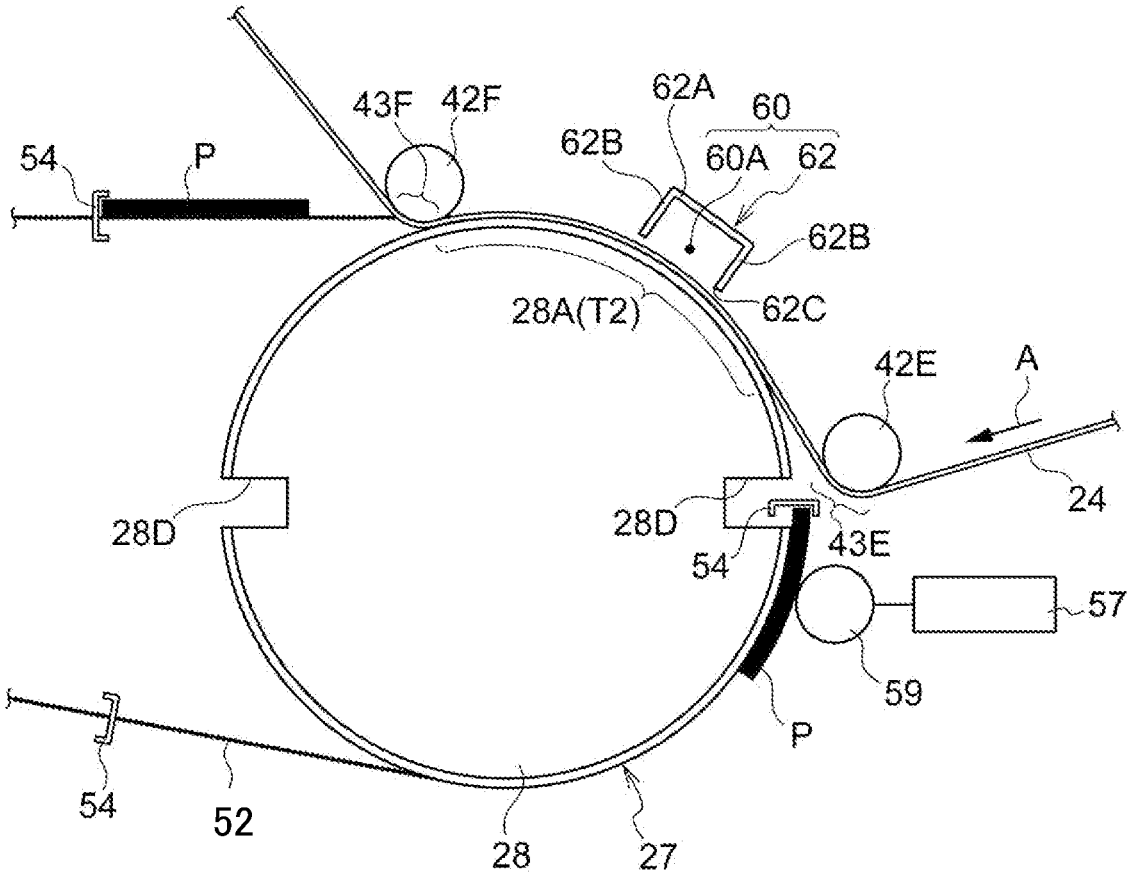
FIG. 8 is an enlarged view illustrating a secondary transfer portion of an image forming apparatus according to a modified example.

As illustrated in FIG. 8, the winding portion 43E may be separated from the transfer cylinder 28, and the winding portion 43F may be in contact with the transfer cylinder 28.

According to this configuration, as compared with a configuration in which both the winding portions 43E, 43F are separated from the transfer cylinder 28, the nip region 28A is wider in the belt circulation direction A. In addition, as compared with a configuration in which the winding portion 43E of the winding roller 42E is in contact with the transfer cylinder 28, the recording medium P is likely to be guided to the nip region 28A.

Figure 9:
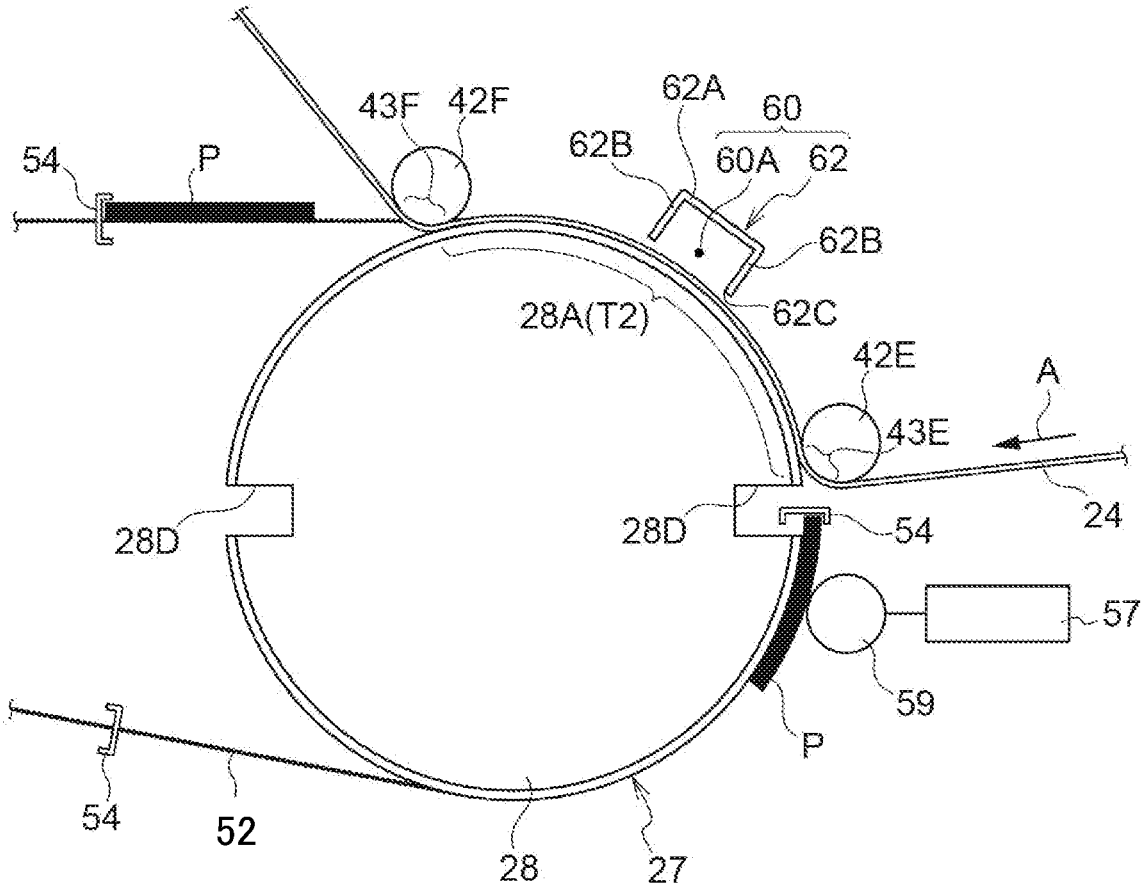
FIG. 9 is an enlarged view illustrating a secondary transfer portion of an image forming apparatus according to a modified example.

Furthermore, as illustrated in FIG. 9, both the winding portion 43E and the winding portion 43F may be in contact with the transfer cylinder 28.

According to this configuration, as compared with a configuration in which one of the winding portions 43E, 43F is separated from the transfer cylinder 28, the nip region 28A is wider in the belt circulation direction A.

(Modified Example Related to Charger 60)

In the exemplary embodiment, as illustrated in FIG. 3, the charger 60 faces the transfer cylinder 28 in a region including the center 28S of the nip region 28A in the transport direction of the transport unit 15, but the present disclosure is not limited thereto.

Figure 10:
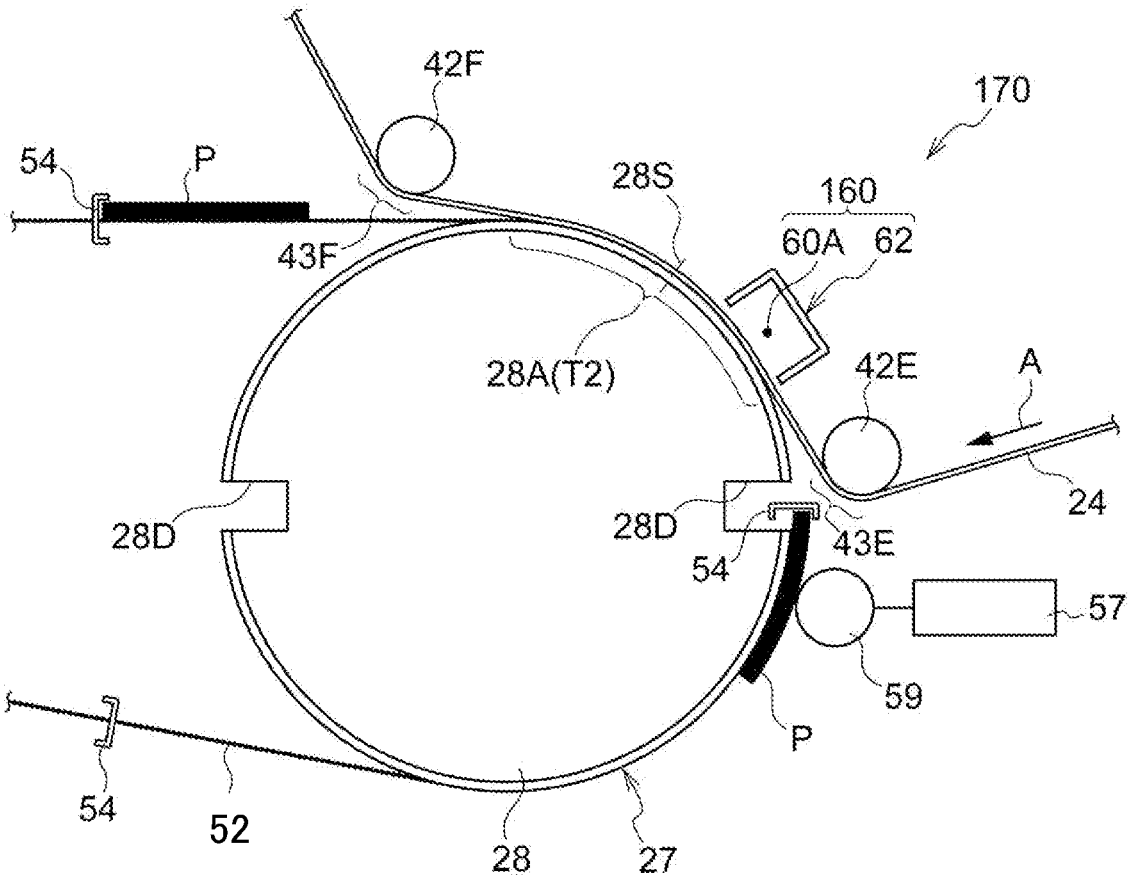
FIG. 10 is an enlarged view illustrating a secondary transfer portion of the image forming apparatus according to a modified example.

For example, as illustrated in FIG. 10, the facing portion may be a facing portion 170 that includes a charger 160 disposed on the upstream side of the center 28S of the nip region 28A. The charger 160 is configured in the same manner as the charger 60 described above. The charger 160 is an example of an upstream facing portion.

According to this configuration, as compared with a configuration in which only the charger disposed in the range on the downstream side from the center 28S of the nip region 28A is provided, the range in which the recording medium P is electrostatically adsorbed to the transfer belt 24 and the transfer cylinder 28 is wider.

Figure 11:
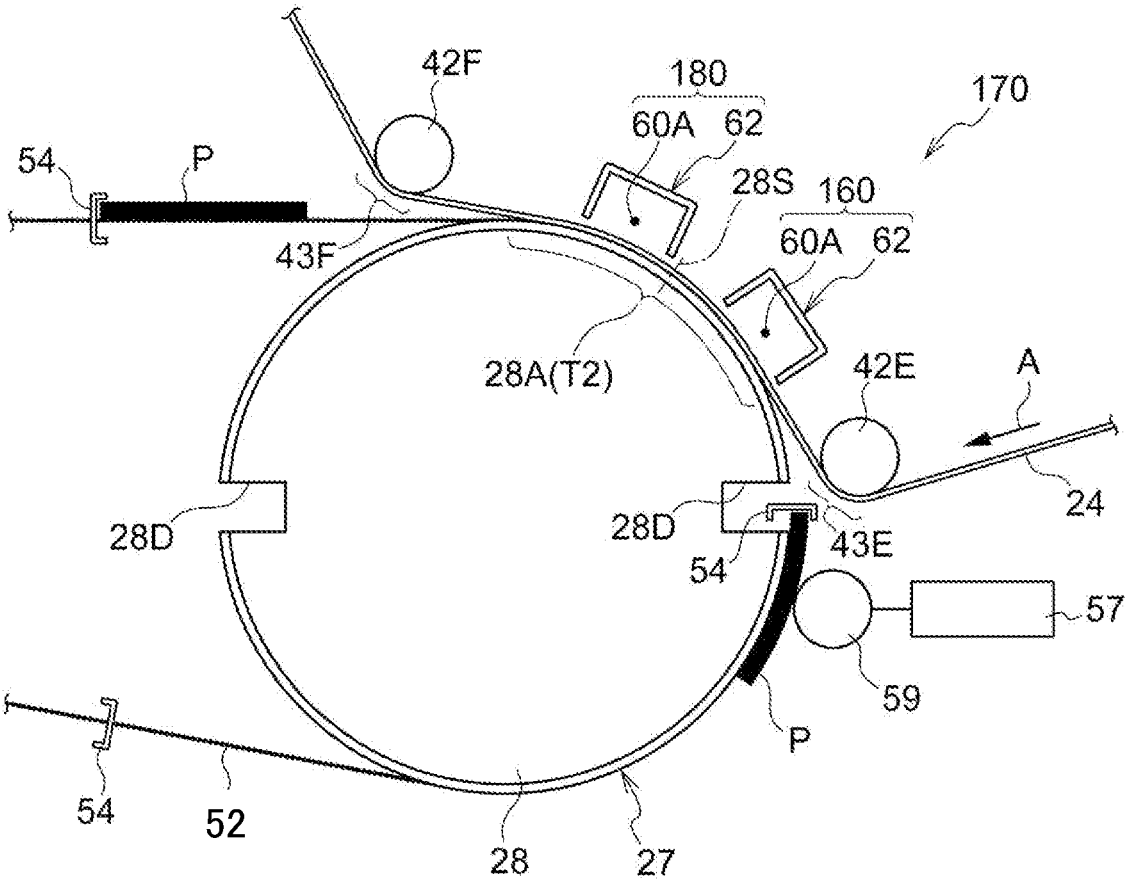
FIG. 11 is an enlarged view illustrating a secondary transfer portion of the image forming apparatus according to a modified example.

Further, as illustrated in FIG. 11, the facing portion 170 may be configured to include a charger 180 that is disposed on the downstream side in the transport direction with respect to the charger 160 and to which a voltage higher than the voltage in the charger 160 is applied. Here, the optimal transfer voltage value for transferring the toner image to the recording medium P is larger than the optimal electrostatic adsorption voltage value for electrostatically adsorbing the recording medium P to the transfer belt 24 and the transfer cylinder 28. For example, an electrostatic adsorption voltage value is applied to the charger 160, and a transfer voltage value is applied to the charger 180. The charger 180 is an example of a downstream facing portion.

In the configuration in which a voltage higher than the voltage in the charger 160 is applied to the charger 180, the charger 160 is provided with a function of electrostatically adsorbing the recording medium P to the transfer belt 24 and the transfer cylinder 28 as a main function, and the charger 180 is provided with a function of transferring the toner image to the recording medium P as a main function. The functions are separated.

(Modified Example Related to Chain 52)

In the exemplary embodiment, as illustrated in FIG. 3, the chain 52 advances between the transfer belt 24 and the transfer cylinder 28 on the downstream side in the transport direction with respect to the nip region 28A in a side view, but the present disclosure is not limited thereto.

Figure 12:
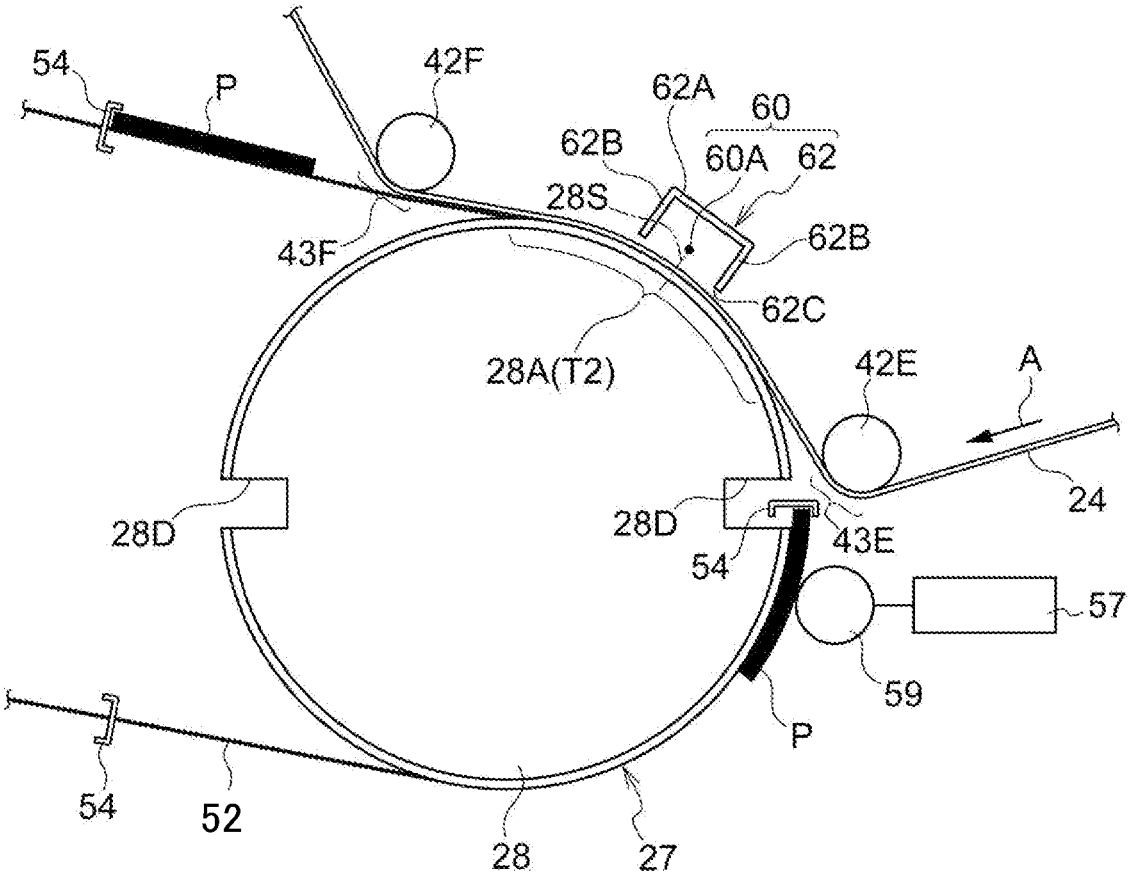
FIG. 12 is an enlarged view illustrating a secondary transfer portion of the image forming apparatus according to a modified example.

For example, as illustrated in FIG. 12, the chain 52 may be configured to advance along the transfer belt 24 on the downstream side in the transport direction with respect to the nip region 28A in a side view. Specifically, in a side view, the chain 52 advances along the transfer belt 24 to the winding portion 43F at the downstream side in the transport direction with respect to the nip region 28A.

Accordingly, the recording medium P transported in a state of being held by the gripper 54 moves along the transfer belt 24 to the winding portion 43F on the downstream side in the transport direction with respect to the nip region 28A, and is peeled from the transfer cylinder 28 before the recording medium P is peeled from the transfer belt 24.

In other words, the configuration illustrated in FIG. 12 is configured to peel off the recording medium P from the transfer cylinder 28 before the recording medium P is peeled off from the transfer belt 24 on the downstream side in the transport direction with respect to the nip region 28A.

Figure 13:
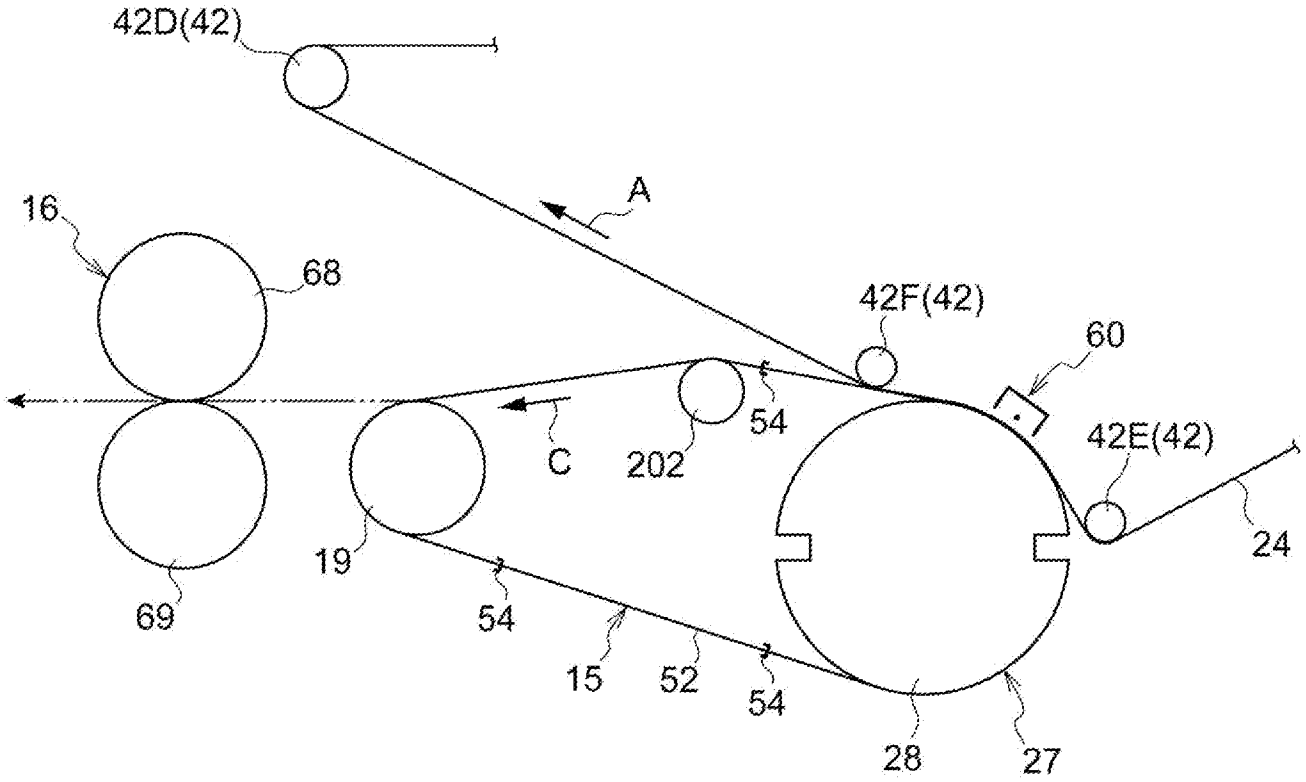
FIG. 13 is a schematic diagram illustrating a transport unit according to a modified example.

As illustrated in FIG. 13, the configuration illustrated in FIG. 12 is realized by, for example, supporting a portion of the chain 52 that advances from the sprocket 29 to the sprocket 19 with a sprocket 202 disposed inside the chain 52.

According to the configuration illustrated in FIG. 12, as compared with the configuration in which the recording medium P is peeled from the transfer belt 24 and then peeled from the transfer cylinder 28 on the downstream side in the transport direction with respect to the nip region 28A, the separation discharge between the transfer belt 24 and the recording medium P is suppressed. As a result, as compared to a configuration in which the recording medium P is peeled from the transfer belt 24 and then peeled from the transfer cylinder 28, scattering of the toner of the toner image transferred to the recording medium P is suppressed.

Figure 14:
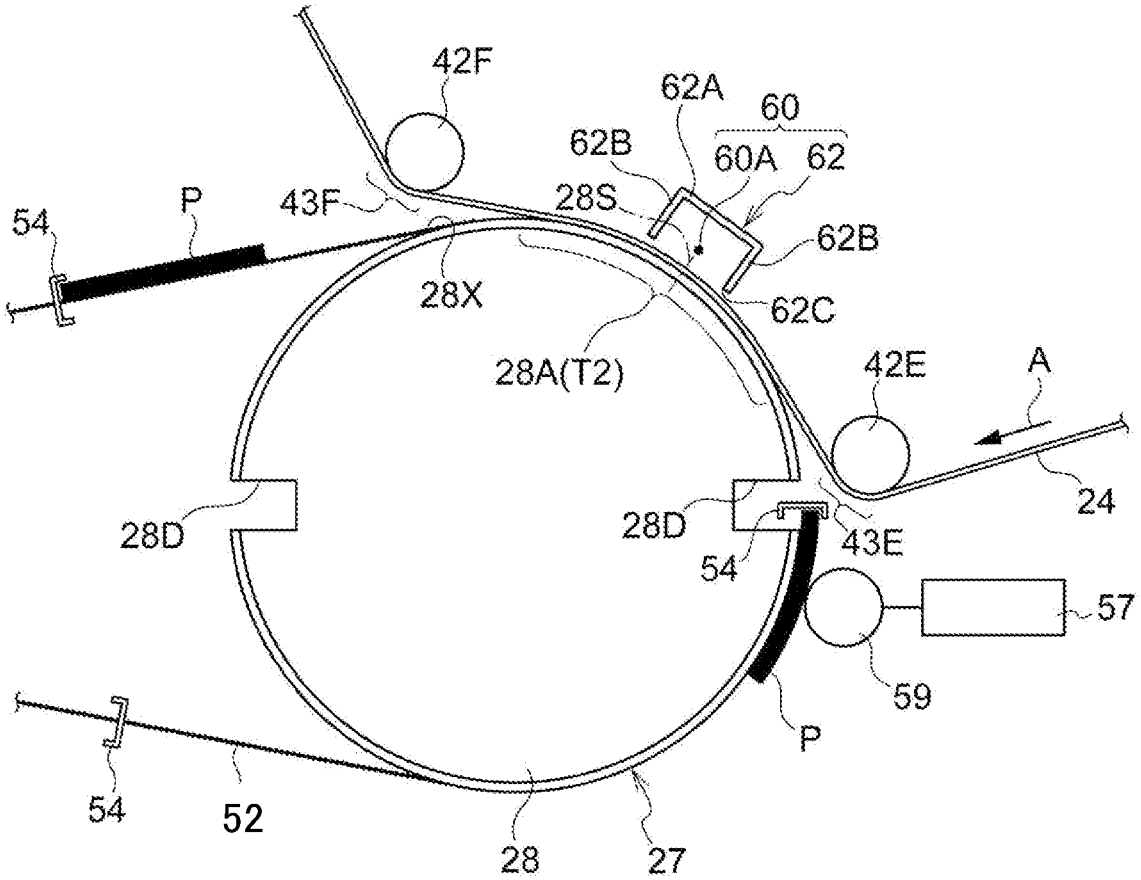
FIG. 14 is an enlarged view illustrating a secondary transfer portion of the image forming apparatus according to a modified example.

Further, instead of the configuration illustrated in FIG. 3, as illustrated in FIG. 14, the chain 52 may be configured to advance along the transfer cylinder 28 on the downstream side in the transport direction with respect to the nip region 28A in a side view. Specifically, the chain 52 advances along the transfer cylinder 28 at least to a facing position 28X facing the winding portion 43F on the downstream side in the transport direction with respect to the nip region 28A in a side view.

As a result, the recording medium P transported in a state of being held by the gripper 54 moves along the transfer cylinder 28 to the winding portion 43F on the downstream side in the transport direction with respect to the nip region 28A, and is peeled from the transfer cylinder 28 after the recording medium P is peeled from the transfer belt 24.

In other words, the configuration illustrated in FIG. 14 is configured to peel the recording medium P from the transfer cylinder 28 after peeling the recording medium P from the transfer belt 24 on the downstream side in the transport direction with respect to the nip region 28A.

Figure 15:
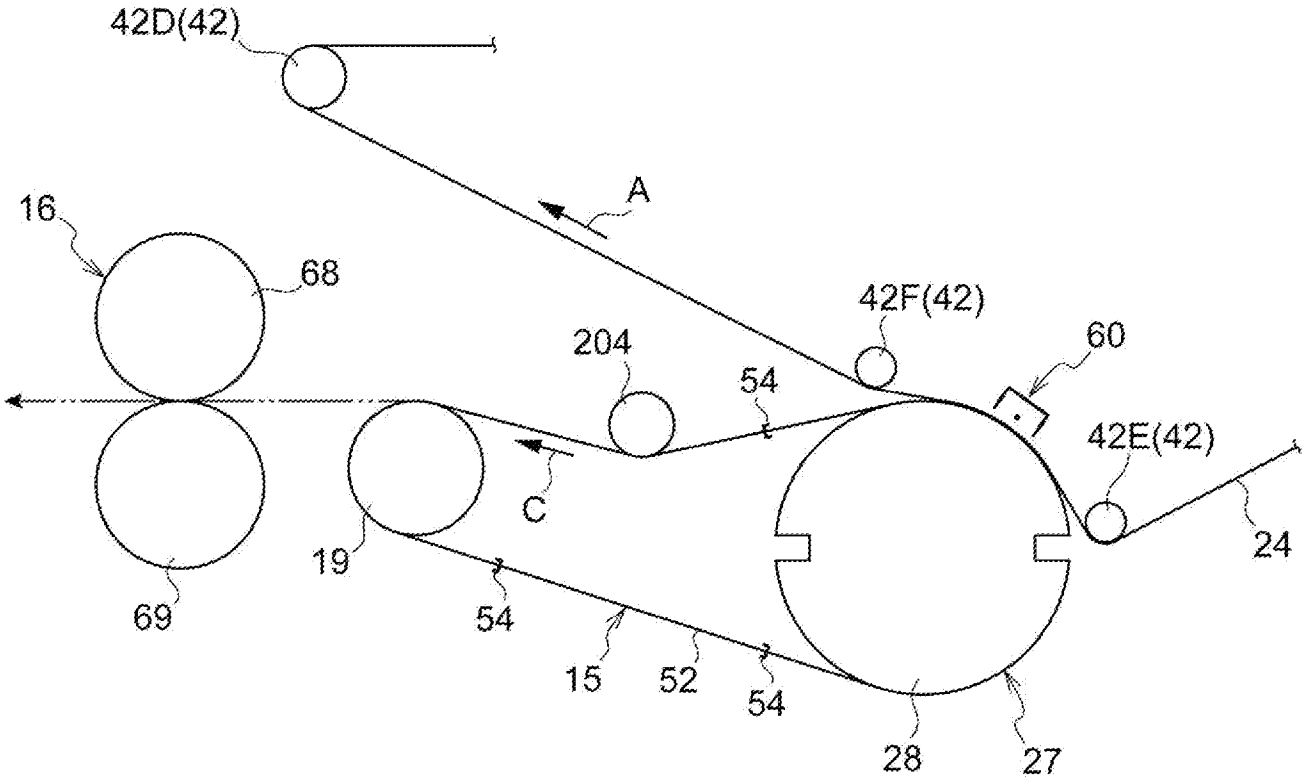
FIG. 15 is a schematic diagram illustrating a transport unit according to a modified example.

For example, as illustrated in FIG. 15, the configuration illustrated in FIG. 14 is realized by supporting a portion of the chain 52 that advances from the sprocket 29 to the sprocket 19 with a sprocket 204 disposed on the outer side of the chain 52.

According to the configuration illustrated in FIG. 14, as compared with a configuration in which the recording medium P is peeled from the transfer cylinder 28 before the recording medium P is peeled from the transfer belt 24 on the downstream side in the transport direction with respect to the nip region 28A, vibration of the recording medium P is suppressed.

Figure 16:
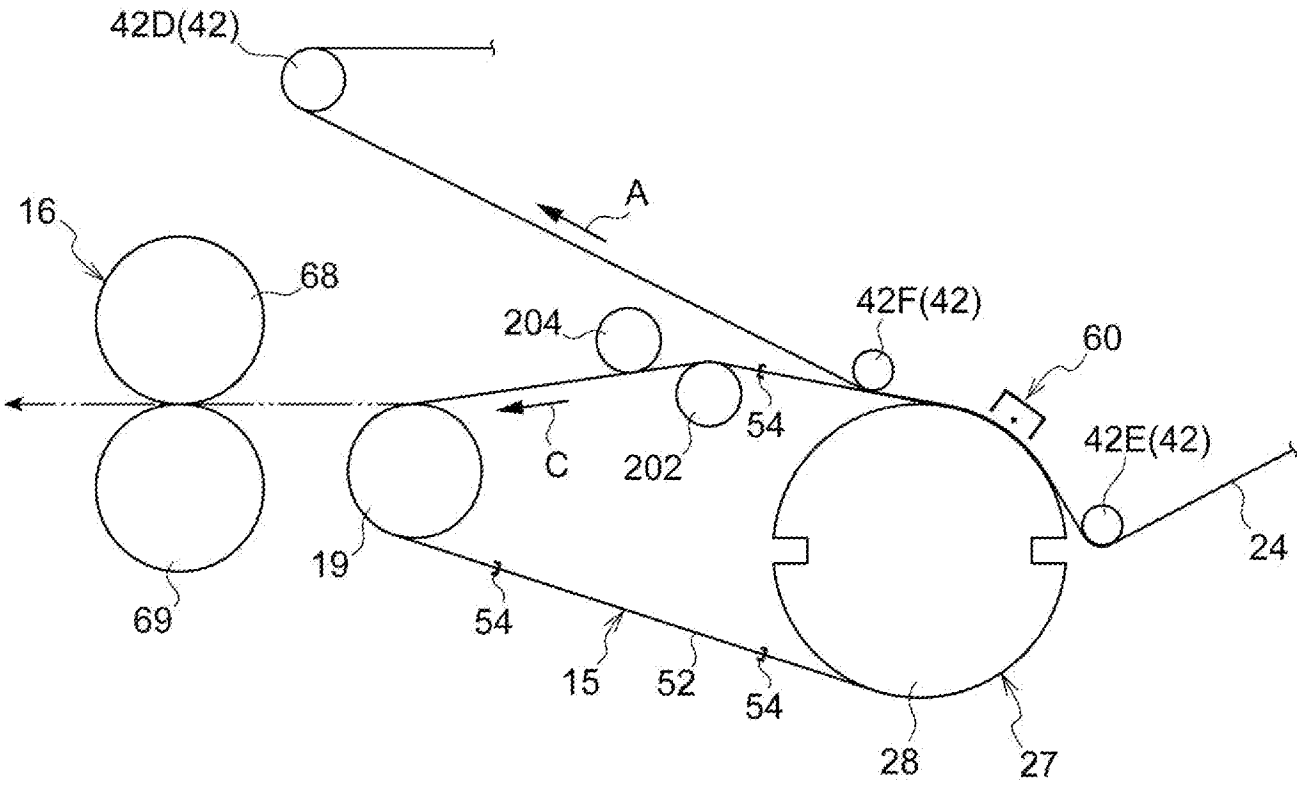
FIG. 16 is a schematic diagram illustrating a transport unit according to a modified example.
Figure 17:
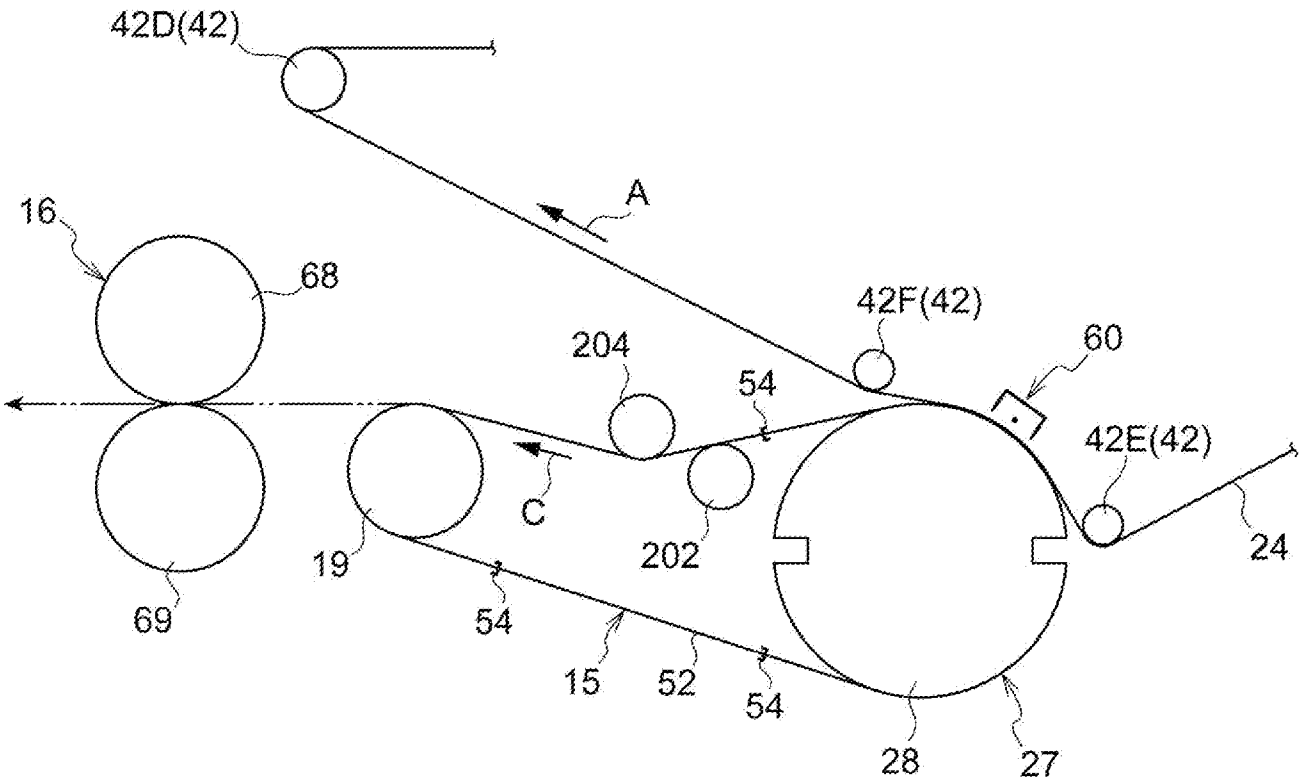
FIG. 17 is a schematic diagram illustrating a transport unit according to a modified example.

Further, as illustrated in FIGS. 16 and 17, a configuration may be provided with the sprocket 202 disposed inside the chain 52 and the sprocket 204 disposed outside the chain 52, in which a state in which the recording medium P is peeled from the transfer cylinder 28 before the recording medium P is peeled from the transfer belt 24 on the downstream side in the transport direction with respect to the nip region 28A (the state illustrated in FIG. 12), and a state in which the recording medium P is peeled from the transfer cylinder 28 after the recording medium P is peeled from the transfer belt 24 on the downstream side in the transport direction with respect to the nip region 28A (the state illustrated in FIG. 14) may be switched.

According to the configuration illustrated in FIG. 16 and FIG. 17, the state illustrated in FIG. 12 and the state illustrated in FIG. 14 are switched according to the situation in which image formation such as the type of the recording medium P is performed. Specifically, for example, the state illustrated in FIG. 14 is set by the configuration illustrated in FIG. 17 in a case where the type of the recording medium P (for example, thick paper) that is effective to suppress the vibration is used, and is switched to the state illustrated in FIG. 12 by the configuration illustrated in FIG. 16 in a case where the type of the recording medium (for example, thin paper) that is effective to suppress the separation discharge between the recording medium P and the transfer belt 24.

Other Modified Examples

In the exemplary embodiment, a so-called corotron is used as the charger 60, but the present disclosure is not limited thereto. For example, a so-called scorotron having a grid may be used as the charger 60.

Figure 18:
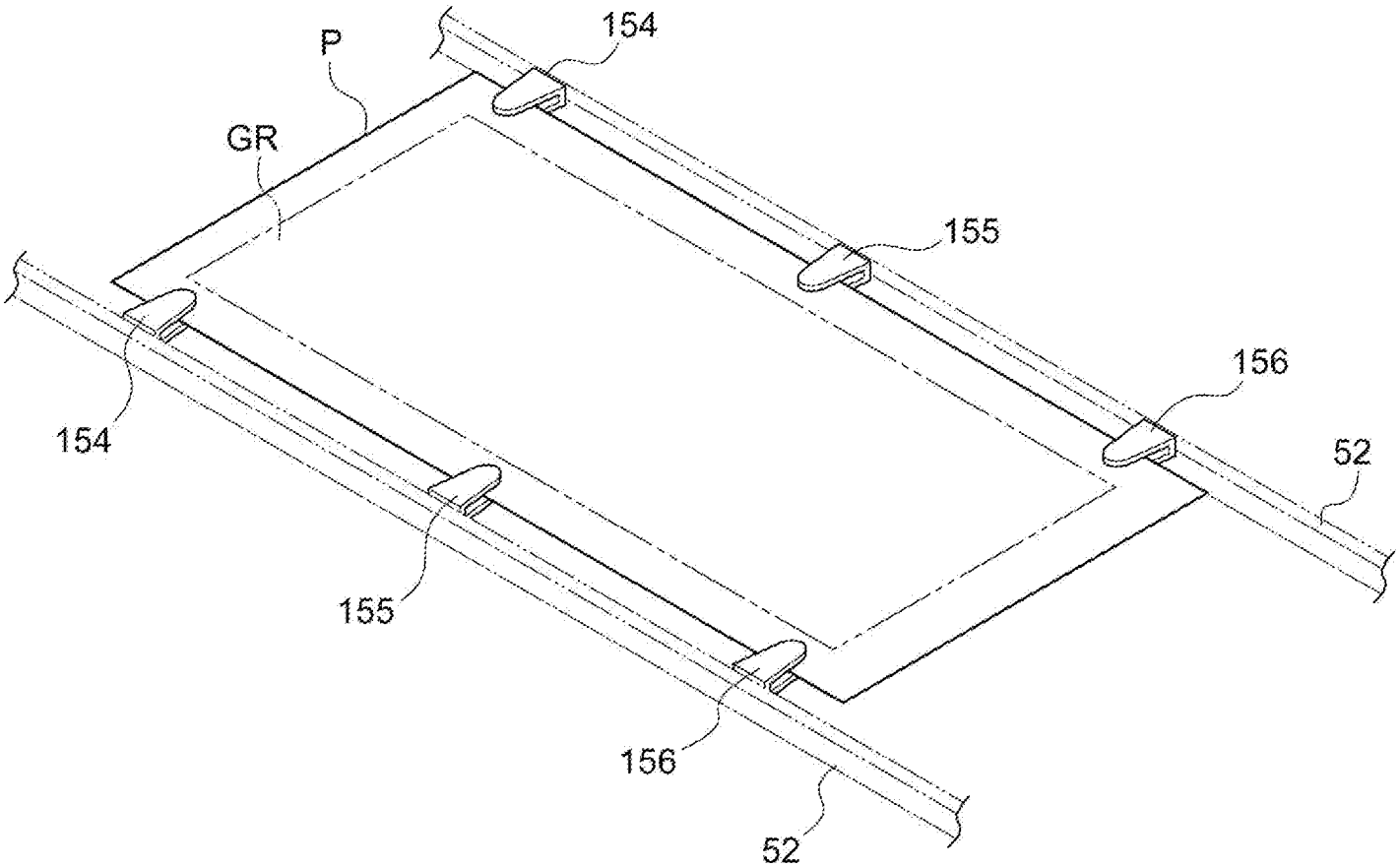
FIG. 18 is a perspective view illustrating a gripper according to a modified example.

In the exemplary embodiment, the gripper 54 as an example of the holding portion holds the front end portion of the recording medium P, but the present disclosure is not limited thereto. For example, as illustrated in FIG. 18, the grippers 154, 155, and 156 that hold the side end portions of the recording medium P may be used as an example of the holding portion. In this configuration, the grippers 154, 155, and 156 hold the recording medium P outside the region GR where the toner image of the recording medium P is transferred. Also in this configuration, when the recording medium P is transported, the grippers 154, 155, and 156 pass through the nip region 28A in a side view. In FIG. 18, the chains 52 are simplified. FIG. 18 illustrates a state in which the recording medium P is transported between the sprocket 29 and the sprocket 19.

The holding portion may include only the gripper 154 that holds the front end side of the recording medium P. The front end side of the recording medium is a portion on the downstream side (front side) of the center in the transport direction of the recording medium.

Figure 19:
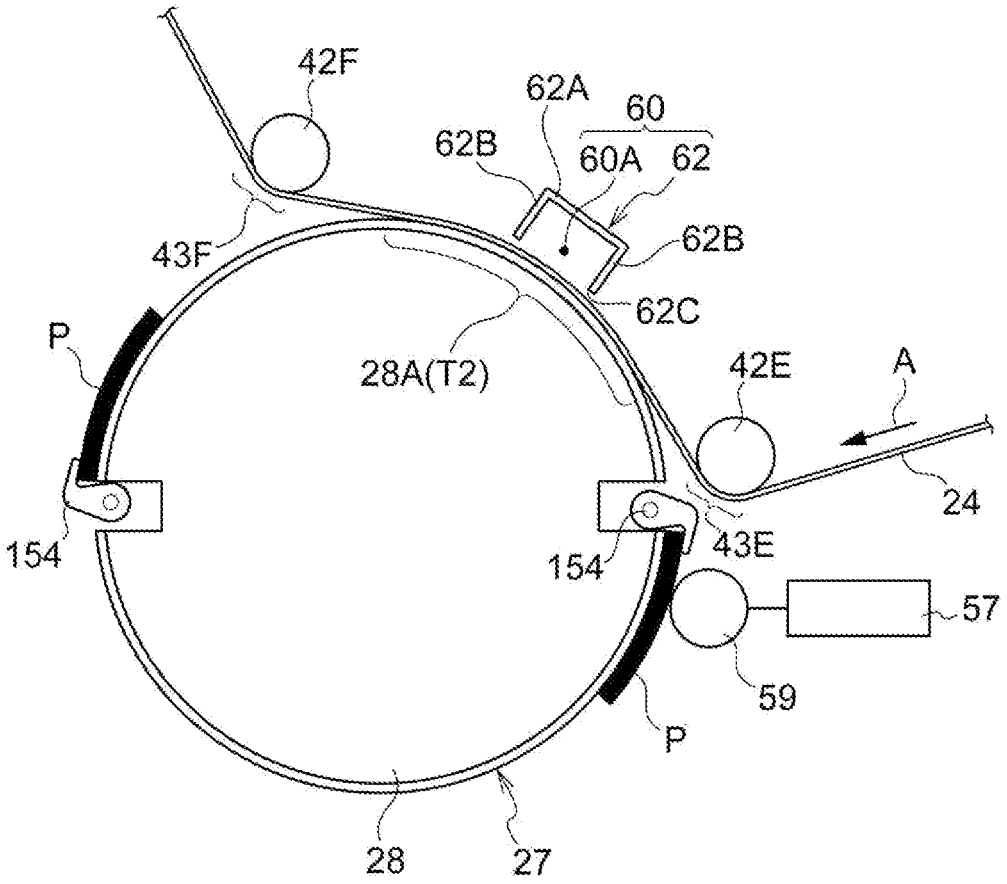
FIG. 19 is an enlarged view illustrating a secondary transfer portion of the image forming apparatus according to a modified example.

In the exemplary embodiment, the transport unit 15 is configured to transport the recording medium P by the gripper 54 provided in the chain 52, but the present disclosure is not limited thereto. For example, as illustrated in FIG. 19, a gripper 154 as an example of a holding portion may be provided in the transfer cylinder 28, and the recording medium P may be nipped between the gripper and the transfer cylinder 28 for transportation. As an example of the transport unit 15, a timing belt and a timing pulley may be used instead of the chain 52 and the sprockets 19, 29.

In the exemplary embodiment, the charger 60 is used as an example of the facing portion, but the present disclosure is not limited thereto. For example, a facing roller that is in contact with the transfer belt 24 may be used as an example of the facing portion. In this case, a voltage is applied to the facing roller.

The present invention is not limited to the above-described exemplary embodiments, and various modifications, changes, and improvements can be made without departing from the scope of the present invention. For example, the modified examples shown above may be combined with each other as appropriate.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an annular transfer belt having an outer surface on which a toner image is transferred;

a transfer portion that has a nip region for nipping a recording medium with an outer surface of the transfer belt, and transfers the toner image from the transfer belt to the recording medium;

a facing portion that faces the nip region from an inner side of the transfer belt and transfers the toner image, with the transfer portion, from the transfer belt to the recording medium in the nip region; and a transport unit comprising a holding portion that holds the recording medium, transports the recording medium by moving the holding portion, and causes the recording medium together with the holding portion to pass the nip region while holding the recording medium at the holding portion, wherein the transport unit has a chain that is wound around on the transfer portion and to which the holding portion is attached, and transports the recording medium by circulating the chain, and wherein the chain is wound around on the nip region.

2. The image forming apparatus according to claim 1, wherein the facing portion comprises an upstream side facing portion disposed on an upstream side with respect to a center of the nip region in the transport direction of the transport unit.

3. The image forming apparatus according to claim 1, wherein the recording medium is peeled from the transfer portion before the recording medium is peeled from the transfer belt on a downstream side in the transport direction of the transport unit with respect to the nip region.

4. The image forming apparatus according to claim 1, wherein the recording medium is peeled from the nip portion transfer portion after the recording medium is peeled from the transfer belt on a downstream side in the transport direction of the transport unit with respect to the nip region.

5. The image forming apparatus according to claim 1, configured to switch between:

a state in which the recording medium is peeled from the transfer portion before the recording medium is peeled from the transfer belt on the downstream side in the transport direction of the transport unit with respect to the nip region; and a state in which the recording medium is peeled from the nip portion after the recording medium is peeled from the transfer belt on the downstream side in the transport direction of the transport unit with respect to the nip region.

* * * * *